US005542660A

United States Patent [19]

Di Cione

[11] Patent Number: 5,542,660

[45] Date of Patent: Aug. 6, 1996

[54] HAND HELD SPHERICAL GAMING DEVICE

[76] Inventor: Giuseppe Di Cione, Via Andreotto Saracini 24, 00121 Roma, Italy

[21] Appl. No.: 194,698

[22] Filed: Feb. 10, 1994

[30] Foreign Application Priority Data

Feb. 10, 1993 [IT] Italy ..... RM930024 U

[51] Int. Cl.[6] ..... A63B 43/00

[52] U.S. Cl. ..... 273/58 R; 473/126; 473/128

[58] Field of Search ..... 273/58 R, 58 A; 473/125, 126, 127, 128, 129, 130

[56] References Cited

U.S. PATENT DOCUMENTS

| | | | |
|---|---|---|---|
| 580,207 | 4/1897 | Boemermann | 473/128 |
| 3,181,864 | 5/1965 | Rolke | 473/126 |
| 3,591,177 | 7/1971 | Skuse | 473/126 |
| 4,320,899 | 3/1982 | Salvino | 473/126 |
| 4,613,137 | 9/1986 | Ruckert | 473/125 |
| 5,125,656 | 6/1992 | Fabanich | 473/126 |

*Primary Examiner*—William H. Grieb
*Attorney, Agent, or Firm*—Barnes, Kisselle, Raisch, Choate, Whittemore & Hulbert, P.C.

[57] ABSTRACT

A spherical gaming device to be held by hand, made out of different materials, having a central core, wherein the central core consists of a removable ball with variable weight and this central core is housed into a first and a second hemispherical hollows, that can mutually fit. The first hemispherical hollow is integral with the spherical gaming device, being at the same time a base of a removable cylindrical portion thereof. The second base of the removable cylindrical portion is a portion of the outside surface of the sphere. The hand-held device also has a pair of drilled holes on the surface of said sphere, that define a first and a second cylindrical hollows to receive the fingers. The removable portion is provided with a trip fastening arrangement.

8 Claims, 3 Drawing Sheets

HAND HELD SPHERICAL GAMING DEVICE

FIELD OF THE INVENTION

This invention relates to a spherical gaming device equipped with a hand-held arrangement.

SUMMARY AND BACKGROUND OF THE INVENTION

More specifically, this invention relates to a gaming device, consisting of a ball with a hand-held arrangement to be used in a novel game, integrating the main features of the bowling and billiard games, to be carried outdoor or indoor, depending upon the seasons and the site characteristics.

In order to point out the novel features of the gaming device of this invention, it must be recalled that the gaming ground of the novel sport shall consist of an obstacle free, rectangular hard surface, having a pocket at each of its four corners, as well as at each middle of its major sides.

The player shall have his own spherical pitch device available to be used as a hitting ball for the numbered balls of the ball set to be holed into the pockets.

The scope of the game is to hole as many balls of the ball set as possible into the pockets. A game as above could o be played either by a single player or player teams.

The game associated exercise, beyond a recreational scope, shall contribute to rectify the player's physical positions of the various limbs and the back bone, as well as to overcome some muscle deficiencies, if any, and to restore the articular mobility.

Accordingly, the innovative equipment consists of a flexible modular system, to be placed outdoor or indoor, being adaptable to the functional and logistic requirements, due to the fact that the gaming area and the poor cushion height allow the equipment to be located even in a very restricted context.

The achievement of the physical/muscular improvement targets of a game as above is strictly associated with the use of a device, that is able to interfere with the player's muscle and bone structure in a controlled way.

Therefore, according to this invention, a spherical shaped, variable weight device to be hand-held is provided, wherein the hand-held arrangement has to meet the anatomical features of a human body, particularly as far the muscle structure is concerned.

Actually, according to the invention, it was found advantageous that the motion of the muscular fascia of the scapula-humerus articulation will be as smooth as possible, being not contracted at all during the motion sequence as follows: backward projection, abduction, adduction, pronation, supination and forward projection.

Further, according to this invention, the spheric device has a diameter, that corresponds to the total length of the entire player's hand, thus prolonging the player's supporting arm.

As to the hand-held arrangement, thumbs and middle fingers will be used advantageously, as they are to be inserted into properly spaced hollows. This, because the thumb shows, when compared with the other five fingers, the largest mobility and has its own muscles, allowing the finger to carry out a number of different motions, whilst the middle finger has, in respect of its own axis, the interosseous dorsal muscles convergent and the palmar muscles divergent.

Features as above allow to involve the anatomic members in the prehension as less as possible, consequently minimizing any energy consumption and any stress accumulation.

Thumb and middle finger shall be advantageously selected, because of:

a) the thumb opposition features, including its all psychophysical implications;

b) the central position of the middle finger in respect of the three remaining fingers, i.e. forefinger, ring finger and little finger, that allows the stress to be distributed throughout the hand and forearm axes, thus preventing extrarotative (supination) or intrarotative (pronation) deflections.

Moreover, existing spherical devices, such as the bowling gaming balls, are available as fixed-diameter and variable-weight balls.

However, the ball weight is always within fixed limits, ranging from 18–20 lbs, depending upon the player's structure and ability, who uses different balls, according to his own physical and gaming conditions.

Furthermore, the weight of each ball is properly distributed in order to balance the lower weight ball area, wherein the hand-held holes are provided.

Therefore, a section of a conventional ball, wherein three hand-held holes are provided, will show a lesser weight than the other ball areas, though the weight differences between the various ball portions must not be higher than a precisely mandatory amount.

As the ball use is obliged to comply strictly not only with some calculation, but also with a more proper weight distribution according to the hand-held arrangement, it results uneasy and troublesome, thus restricting the gaming opportunities to a limited number of players.

In order to overcome these problems, according to this invention, a sphere-shaped device is provided, having a standard diameter and a variable weight, wherein the ball weight variation only depends upon the physical and gaming ability of the player, being only two hand-held hollows provided, allowing an easy grip. The hollows have a coating core, weight of which balances exactly the weight of the removed material to provide the holding arrangement, to prevent any eccentricity problem, and not to influence the weight distribution, in order to obtain the different total weight figures by housing a variable weight core within a hollow ball section at the ball center. Thus, the players of any age and any physical structure are allowed to develop his own involved muscles in a harmonic way.

Therefore, it is a specific object of this invention to provide a gaming spherical ball with a hand-held arrangement, made out of different materials, having a central core, wherein said central core consists of a variable-weight removable sphere; said central core is housed into a first and a second hemispheric hollows, that are able to fit mutually; said first hemispheric hollow is integrated with the ball and defines one of a couple of bases of a removable cylindrical section; the second base of said removable section is a portion of the outside surface of said ball; a trip fastening arrangement is provided along the circumference of said second base; said hand-held arrangement consists of a pair of drilled holes on the outside area of said ball, defining a second finger-hosting cylindrical hollow; said first and second finger-hosting hollows are each provided with an internal coating core.

According to this invention, said spherical gaming device has advantageously a diameter in the range from 18 to 20 cm, preferably 18 cm.

Furthermore, according to this invention, said first and second central core housing hollows have a continuous peripherial thread and are made out of a metal alloy.

A further advantageous feature of this invention consists of said first and second finger-hosting hollows having a coating core, weight of which equals the weight of the removed material when providing the hollows, being such coating core made out of carbon fiber or a metal alloy.

Moreover, in order to facilitate the hand grasp, said middle finger hosting hollow is aligned with the center of said central core.

The spherical gaming devices according to this invention are characterised in being said first and second hemispheric housing hollows made out of a metal alloy, preferably aluminum alloy, and being the ball outside portion made out of a phenolic resin.

DETAILED DESCRIPTION OF THE DRAWINGS

The details of this invention will be now described exemplary, but not limitately, with reference to the annexed drawings, wherein.

DETAILED DESCRIPTION OF THE PREFERRED EMBODIMENT

Figure 1:
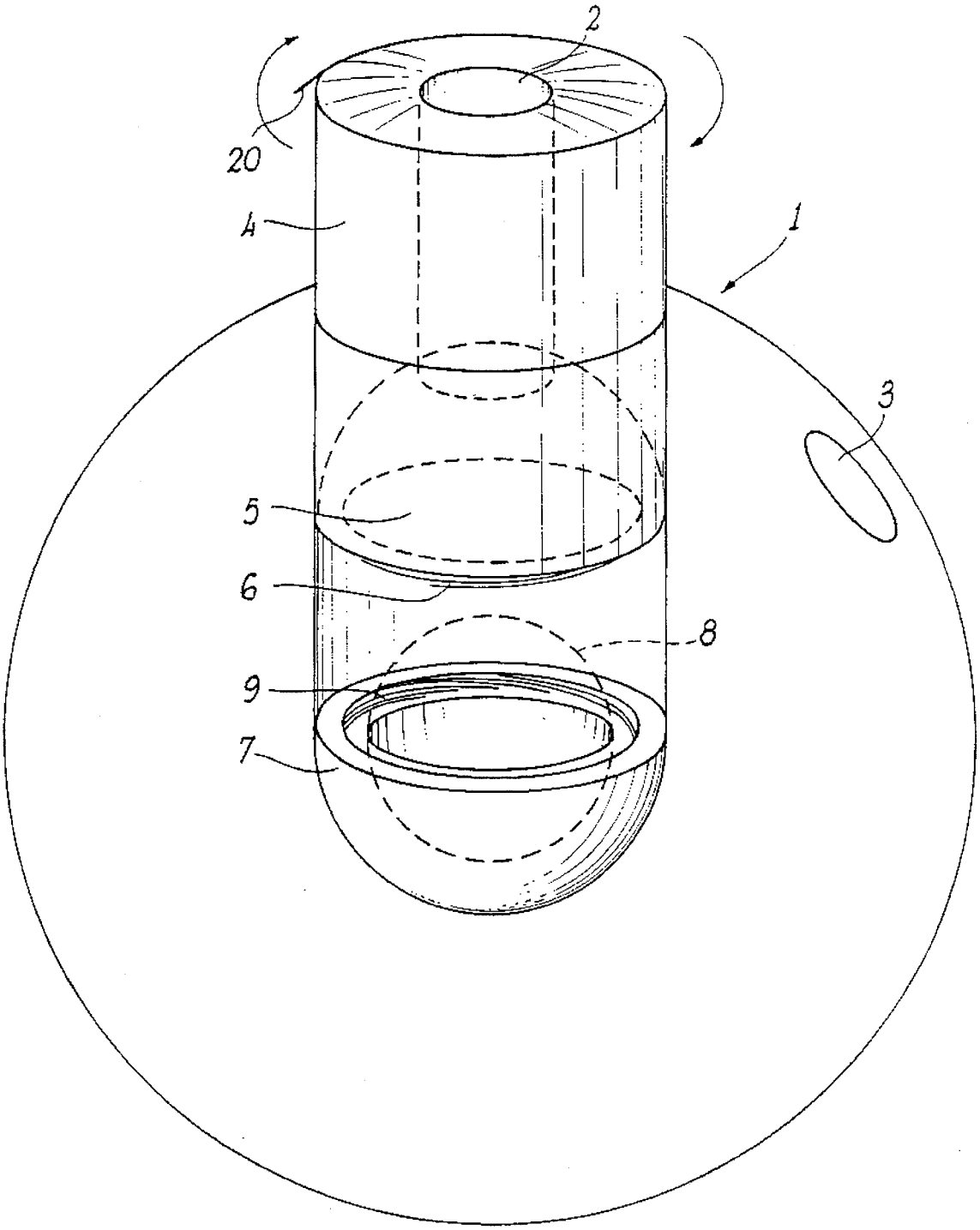
FIG. 1 is an insometric view of the spherical gaming device, wherein the cylindrical portion is partially extracted.
Figure 2:
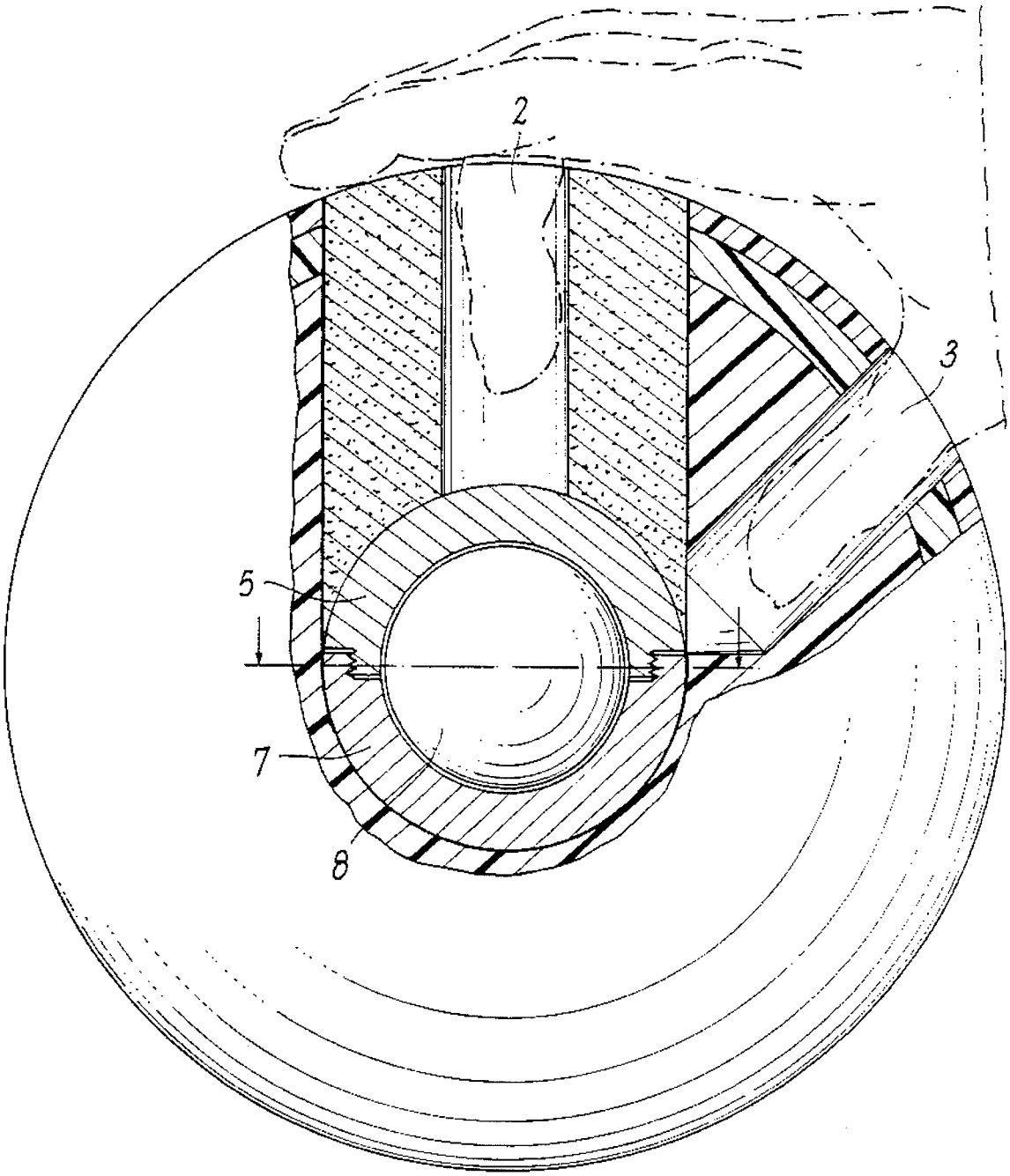
FIG. 2 is a partial vertical cross section of the gaming spherical device of the FIG. 1.

As shown in FIG. 1, the sphere (1) is provided with a couple of hollows (2 and 3), hosting the holding thumb and middle finger respectively.

The hollow (2) is located in correspondence with a cylindrical body (4), that can be extracted from the sphere.

The internal base of this cylinder is shaped in form of an hemispheric hollow profile, thus defining a hemicircular housing hollow (5), equipped with peripheral thread (6).

This hemispheric hollow (5), together with the corresponding hollow (7), located in correspondence of the gravity center of the sphere (1), shall defines the housing of the various spheres (hatched in FIG. 1), which form the variable-weight central core (8) (also hatched in FIG. 1), to be adapted by the various players.

In turn, the hemispheric hollow (7) is provided with a peripheral complementary thread in order to perfectly lock both sections and to house the clearance-free, variable weight core (8) in its interior.

A replacement of the central core can be carried out by jointly pressing and turning the top base of the cylinder (4), this one being equipped with a tang (20) in correspondence of the top base circumference, in order to be trip fastened to the same, thus causing the cylinder being extracted and the central core being replaced, according to the player's physical features.

The hollow (2), that is provided on the outside surface of the cylinder (4), defines the middle finger hosting hollow.

A similar coating (not shown) for the thumb hosting hollow is defined by the opening (3) on the sphere surface in order to avoid any problem of weight eccentricity.

Figure 3:
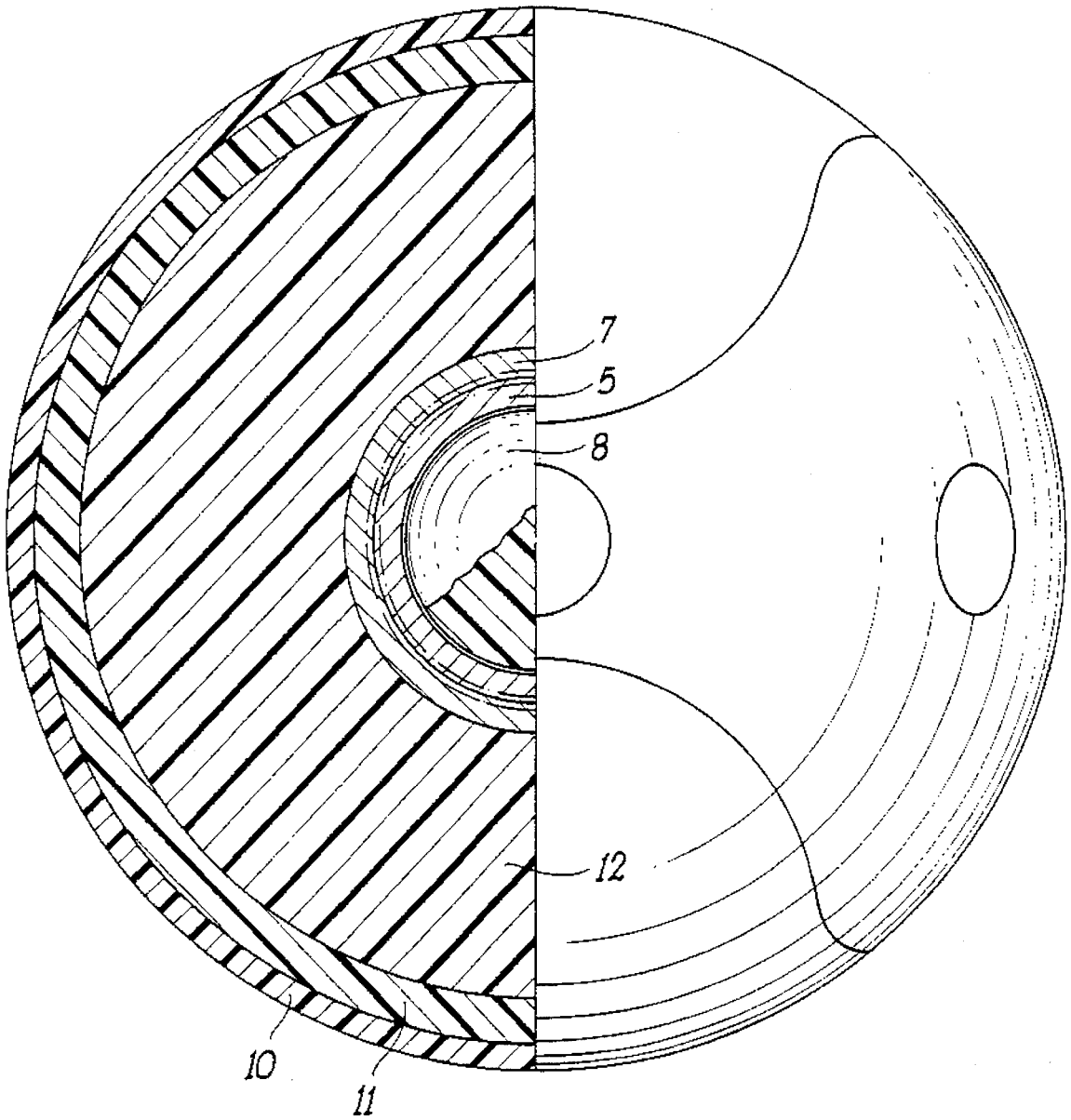
FIG. 3 is a partial horizontal cross section of the gaming spherical device of the FIG. 1.

On the other side, FIG. 3 shows a partial cross section of the sphere (1), aiming to put in evidence the different materials, of which the ball is made.

Specifically, the outside layer is made out of a phenolic resin, while the immediately adjacent layer (11) is made out of high-density urethane foam.

Quite the whole internal portion (12), except the housing hollows (5, 7) in metal alloy, is made out of a lowdensity urethane foam, while the central core (8) is made out of a various density PMMA.

I claim:

1. A hand-held spherical gaming device comprising a spherical ball (1), said ball (1) having a cylindrical opening extending from the exterior to the center of the sphere, a central removable spherical core (8), a spherical cavity for housing said central removable spherical core (8), said spherical cavity comprising a first and a second hemispherical hollows joined together, said first hemispherical hollow having an inner base having a cylindrical portion, said second hemispherical hollow being integral with the ball (1) and forming the base of said cylindrical opening, a cylindrical body inserted in said cylindrical opening and having a first finger receiving hollow therein, said ball having a second finger receiving hollow (3).

2. The spherical gaming device set forth in claim 1 wherein said cylindrical portion is pressed into said cylindrical opening.

3. The spherical gaming device set forth in claim 1 wherein said hollows (5, 7) are joined together by threads.

4. The spherical gaming device set forth in claim 1 wherein said hollows are made of a metal alloy.

5. The spherical gaming device set forth in claim 1, wherein said first and second finger forming hollows have a coating core, the weight of which equals the weight of the removed material when drilling the hollow.

6. A spherical gaming device according to any claim from 1–5, wherein said coating core of said first and second finger forming hollows is made out of a metal alloy.

7. A spherical gaming device according to claim 5, wherein said coating core of said first and second finger forming hollows is made out of carbon fiber.

8. A spherical gaming device according to claim 1, wherein said middle finger forming hollow is aligned with the gravity center of said central core.

* * * * *